US009435113B2

(12) United States Patent
Brandt et al.

(10) Patent No.: US 9,435,113 B2
(45) Date of Patent: Sep. 6, 2016

(54) SYSTEM, METHOD AND APPARATUS FOR ATTIC RAFTER EXTENSION FOR STORAGE

(71) Applicant: CertainTeed Corporation, Malvern, PA (US)

(72) Inventors: Andrew Clyde Brandt, Pottstown, PA (US); David M. Pacana, Spring City, PA (US); Michael Lembo, Souderton, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/717,224

(22) Filed: May 20, 2015

(65) Prior Publication Data

US 2015/0337528 A1 Nov. 26, 2015

Related U.S. Application Data

(60) Provisional application No. 62/001,903, filed on May 22, 2014.

(51) Int. Cl.
*E04B 1/41* (2006.01)
*E04B 5/12* (2006.01)
(Continued)

(52) U.S. Cl.
CPC ..... *E04B 1/40* (2013.01); *B65D 85/70* (2013.01); *E04B 5/12* (2013.01); *E04F 15/02044* (2013.01); *E04B 2103/04* (2013.01);
(Continued)

(58) Field of Classification Search
CPC ..... E04G 23/0266; E04G 23/027; E04F 15/02452
See application file for complete search history.

(56) References Cited

U.S. PATENT DOCUMENTS 3,220,141 A * 11/1965 Goss, III ..... A63H 33/084 446/117
3,362,739 A * 1/1968 Staeger ..... E04B 1/34384 52/285.1
3,686,804 A * 8/1972 Browne ..... E04B 1/346 52/31
(Continued)

FOREIGN PATENT DOCUMENTS

DK WO 2013189498 A1 * 12/2013 ..... E04B 5/12
EP 0714468 B1 12/1999
(Continued)

OTHER PUBLICATIONS

European search report and written opinion for related European Application No. 15168430.5 dated Oct. 1, 2015 (7 pages).*
(Continued)

*Primary Examiner* — Rodney Mintz
(74) *Attorney, Agent, or Firm* — Abel Law Group, LLP; Alexander H. Plache

(57) ABSTRACT

A support structure may have a base having surfaces including a top, a bottom, a front, a rear and sides. A first top slot may be formed in the top and may extend at least partially between the front and the rear. A second top slot may be formed in the top and may extend at least partially between the sides. In addition, a bottom slot may be formed in the bottom. A system for attic storage can include an attic having attic joists. A plurality of support structures, each comprising a base, may be mounted to the attic joists. At least two conventional lumber studs may be included and may extend between adjacent ones of the bases. In addition, a plurality of lumber panels may be mounted to at least one of the bases and the lumber studs.

14 Claims, 11 Drawing Sheets

(51) Int. Cl.
*E04F 15/02* (2006.01)
*B65D 85/00* (2006.01)

(52) U.S. Cl.
CPC ..... *E04F2015/02055* (2013.01); *E04F 2015/02066* (2013.01)

(56) References Cited

U.S. PATENT DOCUMENTS 4,498,268 A * 2/1985 Inman ..... E02B 3/14 52/591.1
5,122,015 A * 6/1992 Shen ..... E02D 29/025 405/21
5,197,251 A * 3/1993 Krysak ..... E04B 1/76 182/222
5,544,459 A * 8/1996 Konger ..... E04B 5/12 52/220.3
5,560,171 A 10/1996 McCoy
5,638,914 A * 6/1997 Kizzia ..... E04G 1/36 182/117
6,157,872 A * 12/2000 Michael ..... E04B 1/34331 700/247
6,293,062 B1 * 9/2001 Chen ..... E04F 15/024 52/126.5
6,901,715 B2 6/2005 Brown et al.
7,389,614 B2 * 6/2008 Sullivan ..... E04B 5/12 52/202
7,591,105 B2 * 9/2009 Balser ..... A47B 88/04 52/29
7,731,131 B2 6/2010 Trueb
8,001,719 B2 * 8/2011 Bayer ..... A01G 1/046 47/1.1
8,015,761 B2 * 9/2011 Wainland ..... A47B 13/003 110/157.1
8,096,087 B2 * 1/2012 Wainland ..... E04B 5/12 108/157.1
8,161,690 B1 * 4/2012 Borne ..... E04B 5/12 404/35
8,567,149 B2 * 10/2013 Kuzmin ..... A63H 33/08 52/592.1
8,769,899 B2 * 7/2014 Barry ..... E04F 15/02452 52/480
8,915,028 B2 * 12/2014 Ferguson ..... E04F 15/02452 52/126.4
9,097,005 B2 * 8/2015 Cave ..... E04B 5/12 52/126.5
9,169,657 B1 * 10/2015 Marek ..... E04F 15/02177 52/483.1
2005/0016098 A1 * 1/2005 Hahn ..... E04C 2/427 52/384
2005/0258722 A1 * 11/2005 Sullivan ..... E04B 5/12 312/245
2006/0277832 A1 * 12/2006 Balser ..... A47B 88/04 52/29
2007/0028550 A1 * 2/2007 Clapper ..... E04G 3/26 52/650.3
2008/0191110 A1 * 8/2008 Wainland ..... E04B 5/12 248/226.11
2008/0245280 A1 * 10/2008 Wainland ..... A47B 13/003 108/153.1
2009/0090279 A1 * 4/2009 Wainland ..... F16B 5/0216 108/42
2010/0133216 A1 * 6/2010 Lanza-Brache ..... E04G 23/0266 211/86.01
2010/0281784 A1 11/2010 Leo
2011/0283644 A1 * 11/2011 Barry ..... E04F 15/02452 52/480
2013/0133282 A1 * 5/2013 Cave ..... E04B 5/12 52/650.1
2013/0232891 A1 * 9/2013 Ferguson ..... E04F 15/02452 52/126.5
2013/0239492 A1 * 9/2013 Cave ..... E04B 5/12 52/126.5
2013/0295368 A1 * 11/2013 Bayer ..... A01G 1/046 428/221
2014/0056653 A1 * 2/2014 Scully ..... B65G 53/44 406/78
2014/0069004 A1 3/2014 Bayer et al.
2014/0080202 A1 3/2014 Bayer et al.
2015/0203246 A1 * 7/2015 Machrowicz ..... F16M 13/00 248/558

FOREIGN PATENT DOCUMENTS

EP 2388384 A2 11/2011
FR 2956590 A 11/2011
GB 822738 10/1959
GB 2316974 A 11/1998
GB 2505155 A * 2/2014 ..... E04B 5/12
JP 09291637 A1 11/1997
WO 9320303 A1 10/1993

OTHER PUBLICATIONS

Attic Construction Using Modern Engineered Timber Components, printed May 2, 2006, pp. 52-69.

* cited by examiner

SYSTEM, METHOD AND APPARATUS FOR ATTIC RAFTER EXTENSION FOR STORAGE

This application claims priority to and the benefit of U.S. Prov. App. No. 62/001,903, filed May 22, 2014, which is incorporated herein by reference in its entirety.

BACKGROUND OF THE INVENTION

1. Field of the Disclosure

The present invention relates in general to attic storage and, in particular, to a system, method and apparatus for attic rafter extensions for storage purposes.

2. Description of the Related Art

The use of home attics for storage space is a common practice. However, the conventional attic architecture of an attic floor covered by protruding rafters and loose fill or batt insulation is not very conducive to forming a storage space. Constructing a storage space in an attic can cause the insulation to be displaced or compressed, which reduces its insulation properties and effectiveness. Some solutions for attic storage involve the use of platforms. Such platforms tend to rest on top of the attic rafters that protrude upward from the attic floor. These platforms can limit the insulation effectiveness to below code requirements. Thus, improvements in attic storage continue to be of interest.

SUMMARY

Embodiments of a system, method and apparatus for attic storage are disclosed. For example, a support structure may have a base having surfaces including a top, a bottom, a front, a rear and sides. A first top slot may be formed in the top and may extend at least partially between the front and the rear. A second top slot may be formed in the top and may extend at least partially between the sides. In addition, a bottom slot may be formed in the bottom.

In other embodiments, a system for attic storage can include an attic having attic joists. A plurality of support structures, each comprising a base, may be mounted to the attic joists. At least two conventional lumber studs may be include and may extend between adjacent ones of the bases. In addition, a plurality of lumber panels may be mounted to at least one of the bases and the lumber studs.

In still other embodiments, a kit can have at least four support structures, each comprising a base. Each of the bases can include surfaces including a top, a bottom, a front, a rear and sides. A first top slot may be formed in the top and may extend at least partially between the front and the rear. A second top slot may be formed in the top and may extend at least partially between the sides. A bottom slot may be formed in the bottom. The kit also may include a container for containing the at least four bases.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
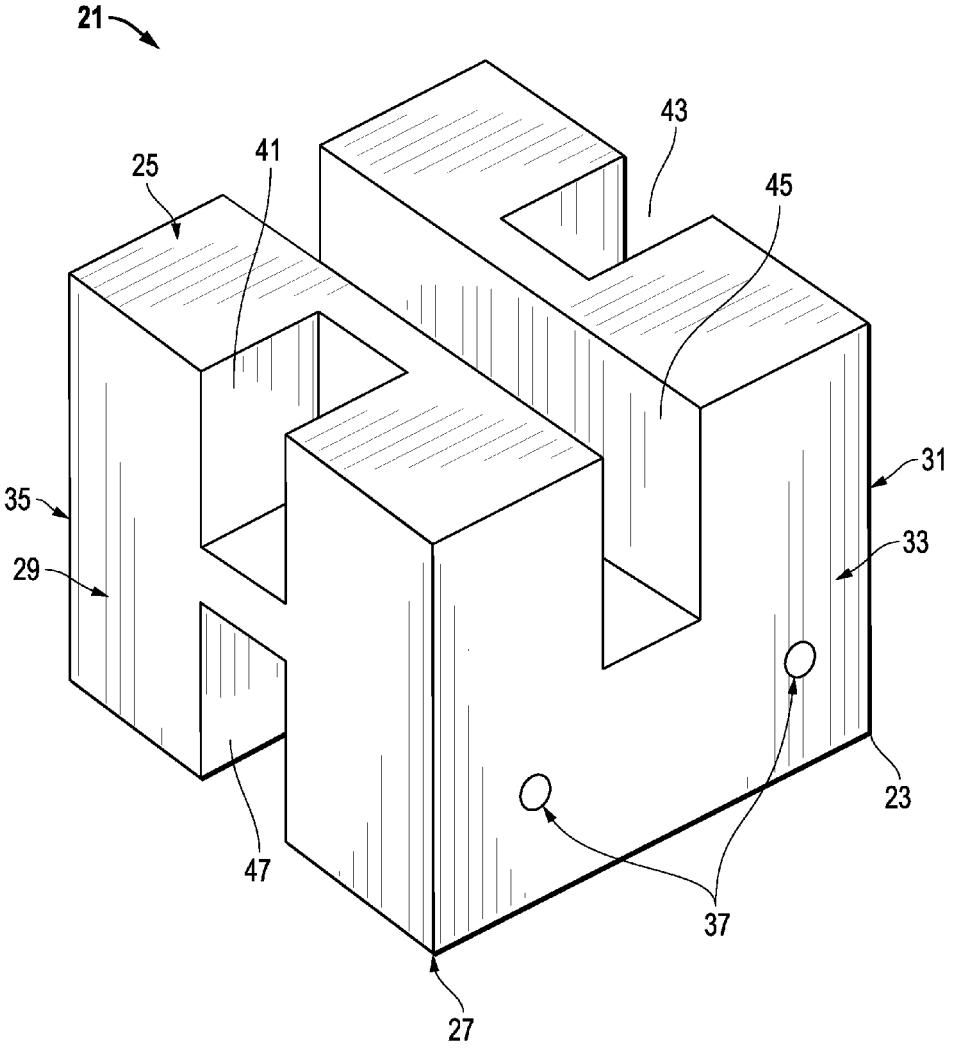
FIG. 1 is a front isometric view of an embodiment of a support structure.

Embodiments of a system, method and apparatus for an attic storage solution are disclosed. For example, as shown in FIG. 1, a support structure 21 may comprise a base 23. Although the base 23 is depicted as a block in a substantially rectilinear configuration, many other shapes and sizes (e.g., curvilinear, such as spherical are feasible depending on the application. The base 23 can be substantially cubic in shape. In addition, the base 23 can be solid or hollow.

Embodiments of the base 23 can have surfaces, including a top 25, a bottom 27, a front 29, a rear 31 and sides 33, 35. Some versions of the base 23 may include one or more apertures, such as slots. Each slot may be configured to receive conventional lumber studs, as described elsewhere herein.

Figure 2:
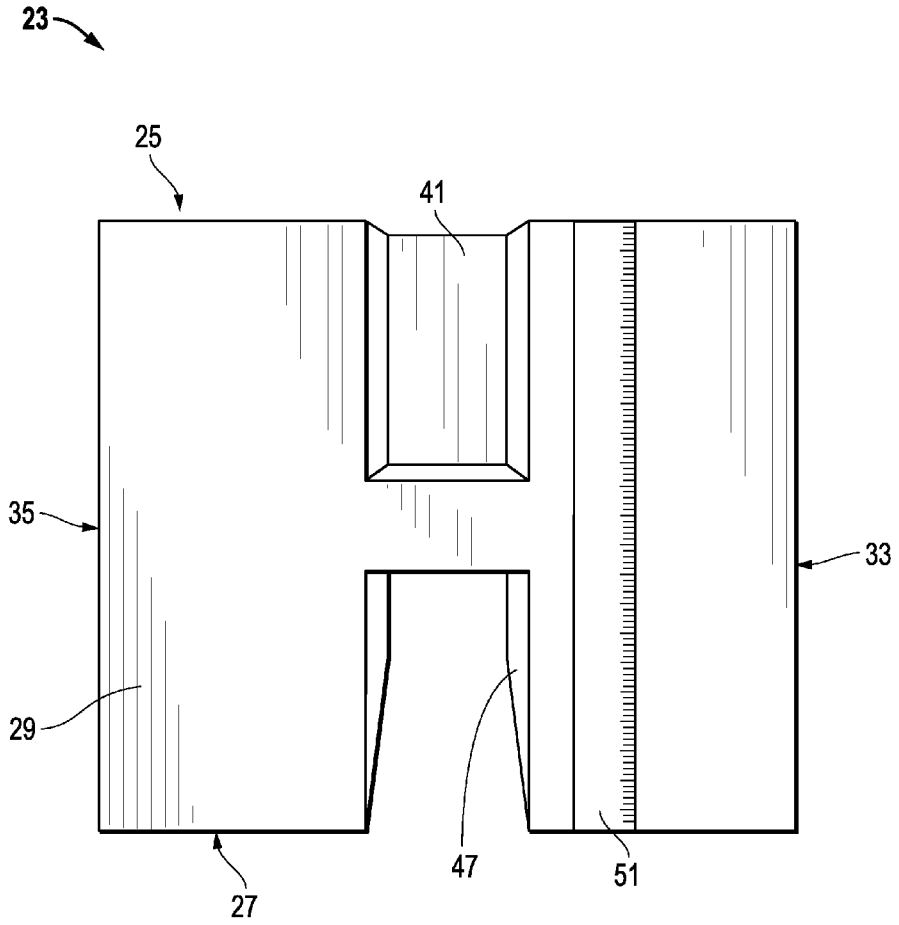
FIG. 2 is a front view of an embodiment of a support structure.
Figure 3:
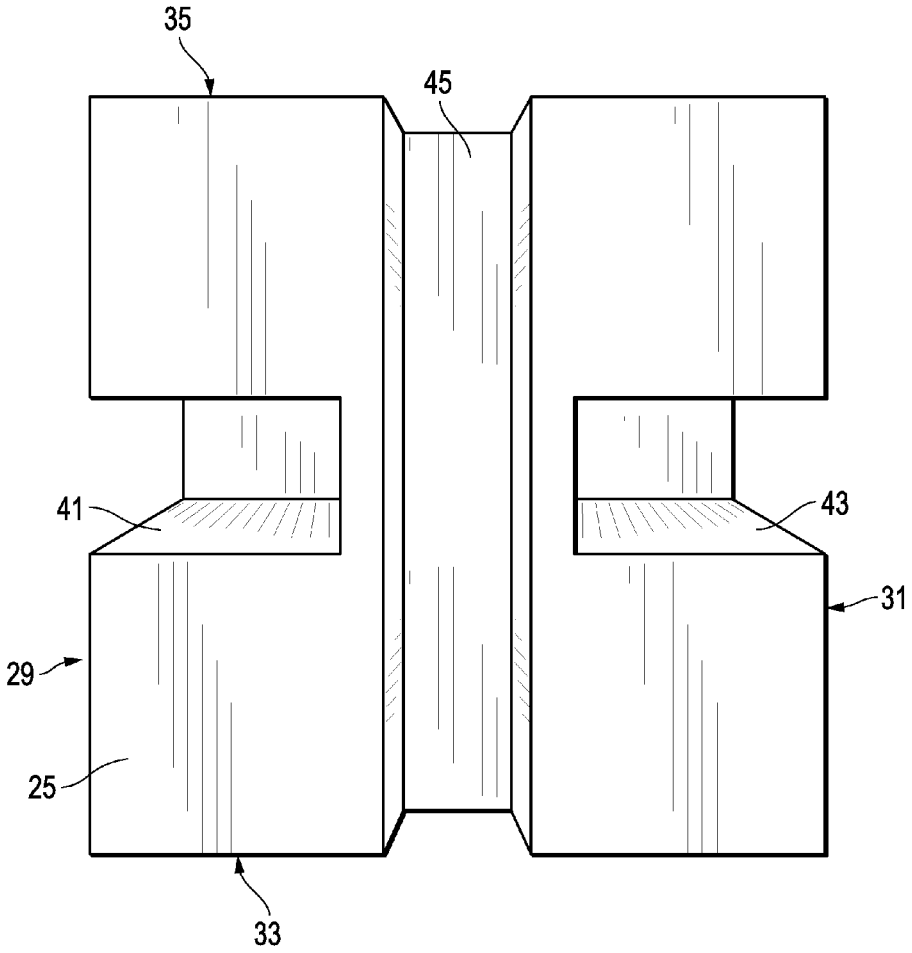
FIG. 3 is a top view of an embodiment of a support structure.
Figure 4:
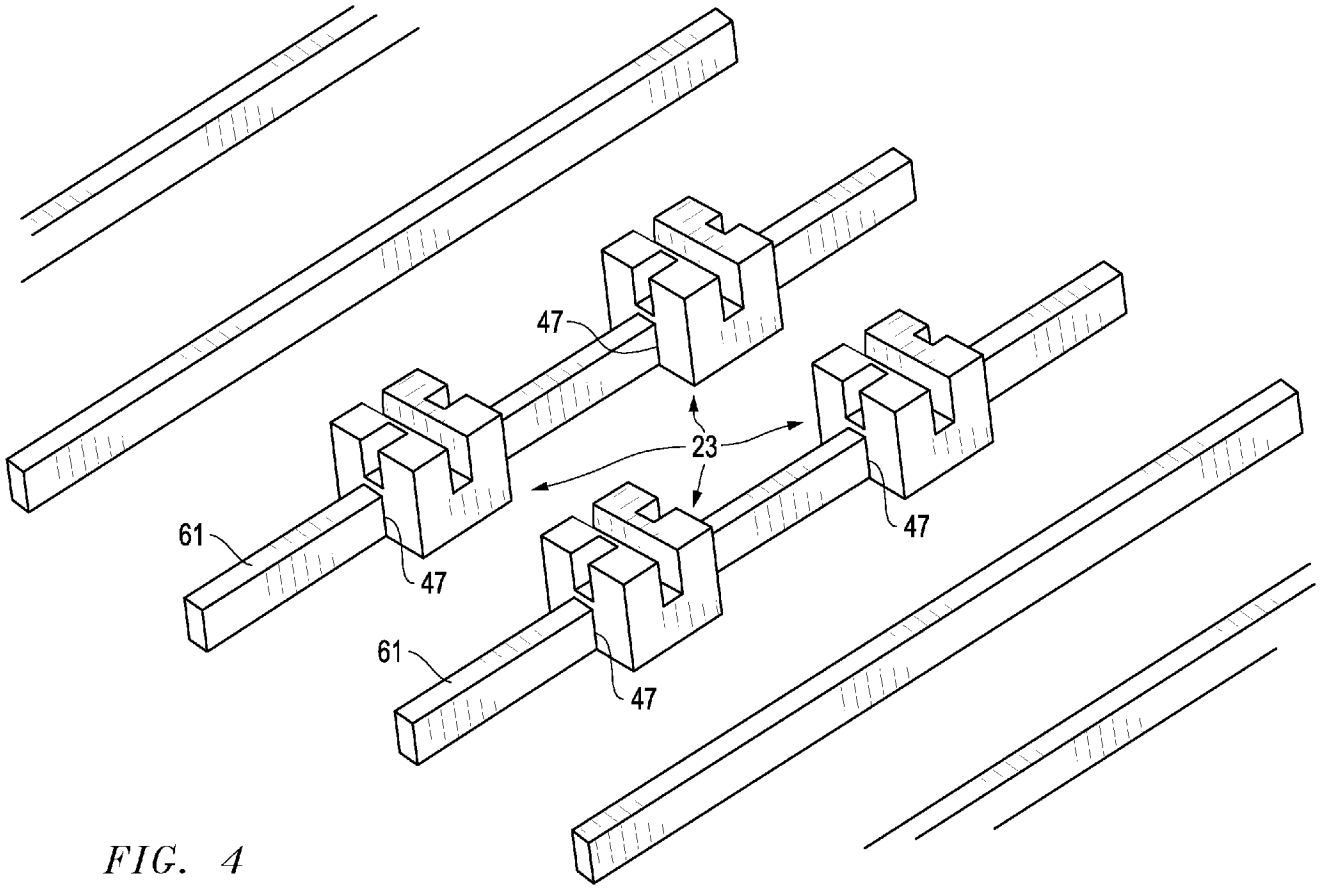
FIG. 4 is a front isometric view of an embodiment of an attic storage system partially installed on rafters.

For example, and as shown in FIGS. 1-3, a first top slot 41 (e.g., a top front slot 41) may be formed in the top 25. The first top slot 41 can extend at least partially between the front 29 and the rear 31. In the embodiment shown (FIG. 3), the top front slot 41 can extend from the front 29 to adjacent a center of the top 25. In addition, the top front slot 41 can extend along the front 29 (FIG. 2) from the top 25 to adjacent a center of the front 29.

In some embodiments, the first top slot 41 further comprises a top rear slot 43 as well. The top rear slot 43 can extend at least partially between the sides 33, 35. In the embodiment shown (FIG. 3), the top rear slot 43 can extend from the rear 31 to adjacent the center of the top 25. In addition, the top rear slot 43 (FIG. 3) can extend along the rear 31 from the top 25 to adjacent a center of the rear 31.

Embodiments of the base 23 may include a second top slot 45 formed in the top 25. As shown in FIG. 3, the second top slot 45 can extend completely across the top 25 from side 33 to side 35.

Figure 10:
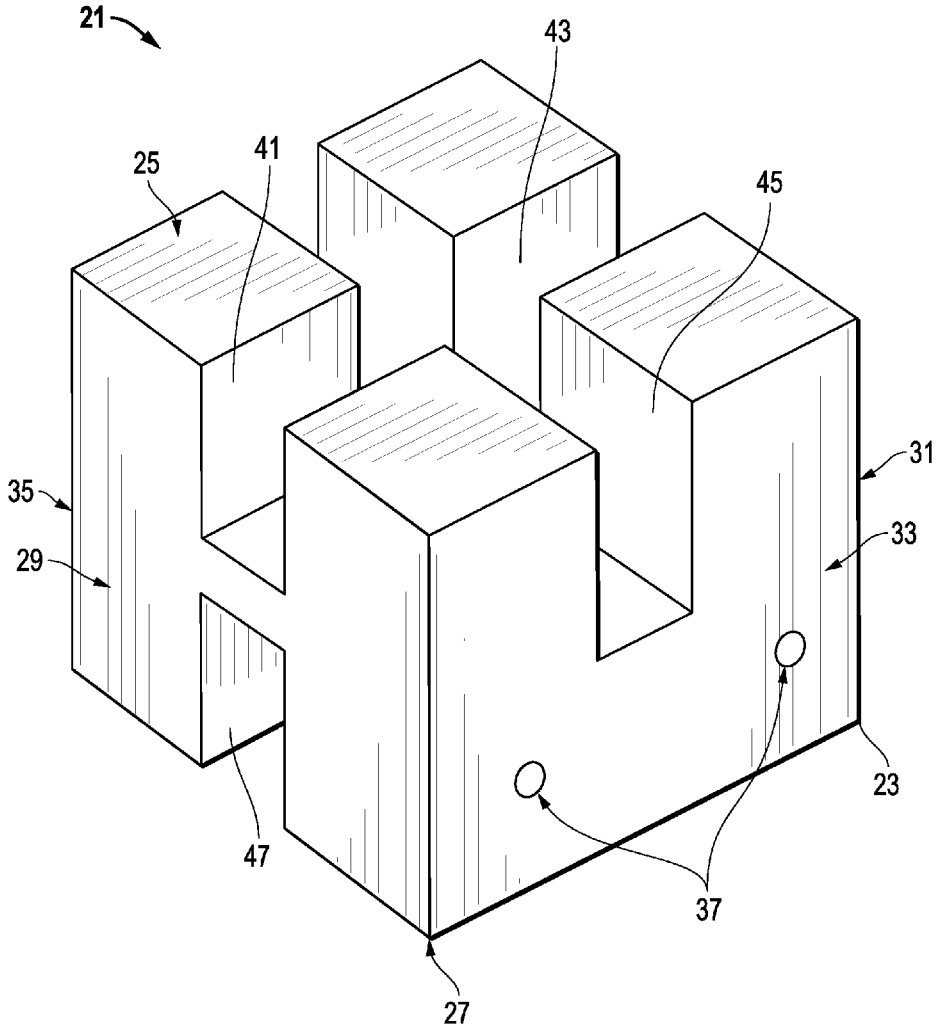
FIG. 10 is front isometric view of another embodiment of a support structure.
Figure 11:
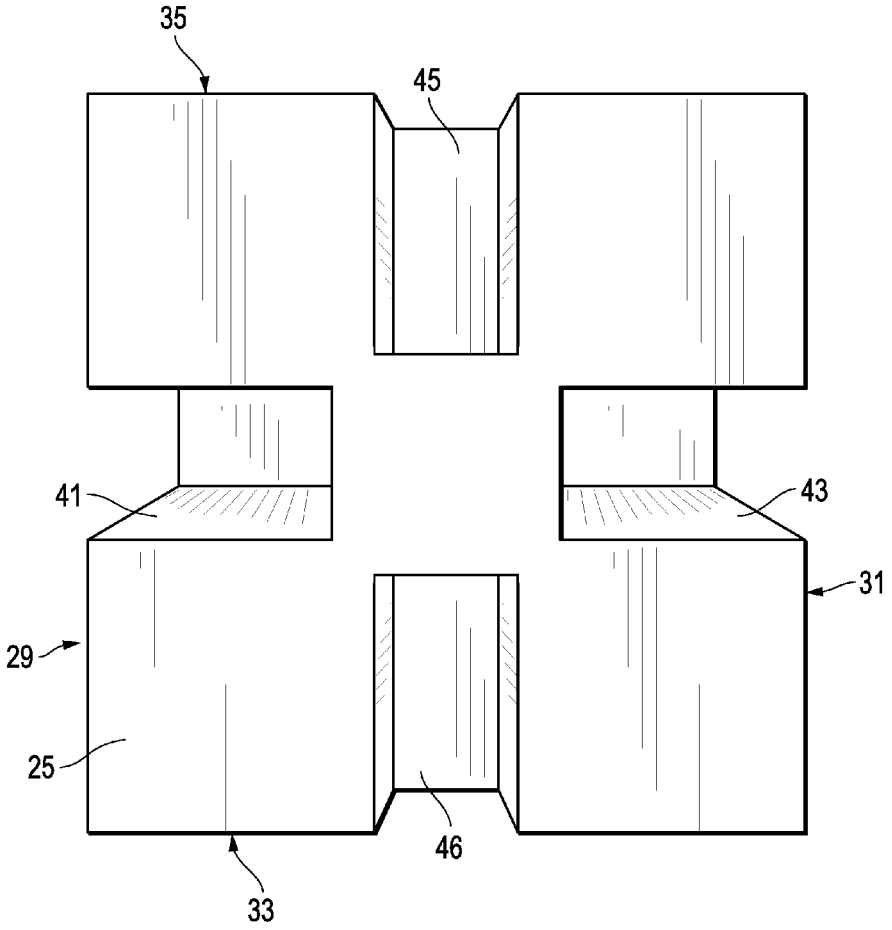
FIG. 11 is a top view of another embodiment of a support structure.

In some versions, the top front slot 41 can be separated from the top rear slot 43 by the second top slot 45. Alternatively, the first and second top slots 41, 45 can intersect (FIG. 10) and extend completely across the top 25. When base 23 is configured as illustrated herein, the top 25 may comprise the third top slot (e.g., top rear slot 43) for a total of only three slots 41, 43, 45 in the top 25. In still another embodiment, the top 25 comprises a fourth top slot 46 (FIG. 11), such that none of the four top slots 41, 43, 45, 46 intersect each other.

Embodiments of the base 23 may include a bottom slot 47 formed in the bottom 27. For example, the bottom slot 47 can extend partially or completely across the bottom 23 from front 29 to back 31, or from side 33 to side 35. In some versions, the bottom slot 47 is the only slot in the bottom 23. The bottom slot 47 may be oriented perpendicular to the second top slot 45.

In some versions, all of the slots 41, 43, 45, 47 can be orthogonal to each other. In other versions, at least two of the slots 41, 43, 45, 47 can intersect each other at an angle that is not orthogonal. In another embodiment, the slots 41, 43, 45, 47 can be orthogonal to each other, but not orthogonal to the surfaces of the base 23. In alternate embodiments, the slots 41, 43, 45, 47 are not orthogonal to each other, and not orthogonal to the surfaces of the base 23. In still another embodiment, none of the slots 41, 43, 45, 47 intersect each other.

Embodiments of the support structure 21 may include a base 23 formed from one or more materials. For example, an entirety of the base 23 may be formed from a single material, or a composite of materials. The base 23 also may include one or more reinforcement materials and/or structures. In other examples, a stronger material can be used to reinforce the base in areas where other elements engage with it. In a particular embodiment, the slots 41, 43, 45, 47 could be reinforced with one or more materials such as metal, plastic and wood to improve the strength of the system at the connection points.

In some embodiments, the base 23 may comprise at least one of an inorganic material, an organic material, an organic material other than wood, fungal material and mycelium foam. In other examples, the base 23 may comprise at least one of an open cell structure, a closed cell structure, a polymeric foam, a rigid polyurethane, polystyrene, polypropylene, a cellular plastic and a rigid plastic. In still other embodiments, the base 23 may comprise one or more of the materials disclosed in U.S. Pat. No. 8,001,719, and U.S. Publications 2013/0295368 and 2014/0056653, each of which is incorporated herein by reference in its entirety.

Other versions of the support structure 21 may include the base 23 comprising one or more specific properties. For example, the base 23 can have at least one of the following properties.

Embodiments of the base 23 can have a desirable density. For example, the density of the base can be at least about 0.5 $lb/ft^3$. In other versions, the base can have a density of at least about 1 $lb/ft^3$, at least about 2 $lb/ft^3$, at least about 5 $lb/ft^3$, or even at least about 10 $lb/ft^3$. In still other embodiments, the base can have a density of not greater than about 25 $lb/ft^3$, such as not greater than about 20 $lb/ft^3$, not greater than about 15 $lb/ft^3$, not greater than about 12 $lb/ft^3$, or even not greater than about 10 $lb/ft^3$. Other embodiments of the base material can have a density in a range between any of these values.

Some embodiments of the base can have a desirable insulation rating. For example, the insulation rating of the base can be at least about R0.5/inch. Other versions of the base can have an insulation rating of at least about R1/inch, such as at least about R2/inch, at least about R3/inch, at least about R4/inch, or even at least about R5/inch. In other examples, the base material can have an insulation rating of not greater than about R9/inch, such as not greater than about R8/inch, not greater than about R7/inch, not greater than about R6/inch, not greater than about R5/inch, or even not greater than about R4/inch. Other embodiments of the base material can have an insulation rating in a range between any of these values.

Embodiments of the base material can have other desirable properties such as, for example, fastener retention performance. The fasteners may comprise screws or nails. Fastener retention performance may be defined by an industry standard, such as ASTM D1037. In some versions, the screw hold strength or nail pull strength of embodiments disclosed herein can be similar to that for conventional #2 yellow pine lumber.

In some embodiments, the nail pull strength of the base material for a 16d nail can be at least about 5 lbs. In other versions, the nail pull strength can be at least about 10 lbs, such as at least about 25 lbs, at least about 50 lbs, at least about 100 lbs, or even at least about 150 lbs. In other versions, the nail pull strength can be not greater than about 350 lbs, such as not greater than about 300 lbs, not greater than about 250 lbs, not greater than about 200 lbs, not greater than about 150 lbs, or even not greater than about 100 lbs. Other embodiments of the base material can have a nail pull strength in a range between any of these values.

In other embodiments, the base material can have a screw hold strength (for a ½" lag screw) of at least about 25 lbs. For example, the screw hold strength can be at least about 35 lbs, at least about 50 lbs, at least about 100 lbs, at least about 200 lbs, at least about 300 lbs, or even at least about 400 lbs. In still other versions, the screw hold strength can be not greater than about 1000 lbs, such as not greater than about 900 lbs, not greater than about 800 lbs, not greater than about 700 lbs, not greater than about 600 lbs, or even not greater than about 500 lbs. Other embodiments of the base material can have a screw hold strength in a range between any of these values.

Embodiments of the base material also can have a desirable compression or crush resistance. For compressive strength, it can be desirable that the base element have a compressive resistance of at least about 15 $lbs/ft^2$. Such a value can represent a reduction in thickness of the base material of about 10% for a general load support. In other versions, the compressive resistance can be at least about 25 $lbs/ft^2$, such as at least about 40 $lbs/ft^2$, at least about 50 $lbs/ft^2$, at least about 60 $lbs/ft^2$, or even at least about 70 $lbs/ft^2$. In other examples, the compressive strength can be not greater than about 600 $lbs/ft^2$, such as not greater than about 500 $lbs/ft^2$, not greater than about 400 $lbs/ft^2$, not greater than about 300 $lbs/ft^2$, not greater than about 200 $lbs/ft^2$, not greater than about 150 $lbs/ft^2$, not greater than about 125 $lbs/ft^2$, or even not greater than about 100 $lbs/ft^2$. Other embodiments of the base material can have a compressive resistance in a range between any of these values.

Figure 9:
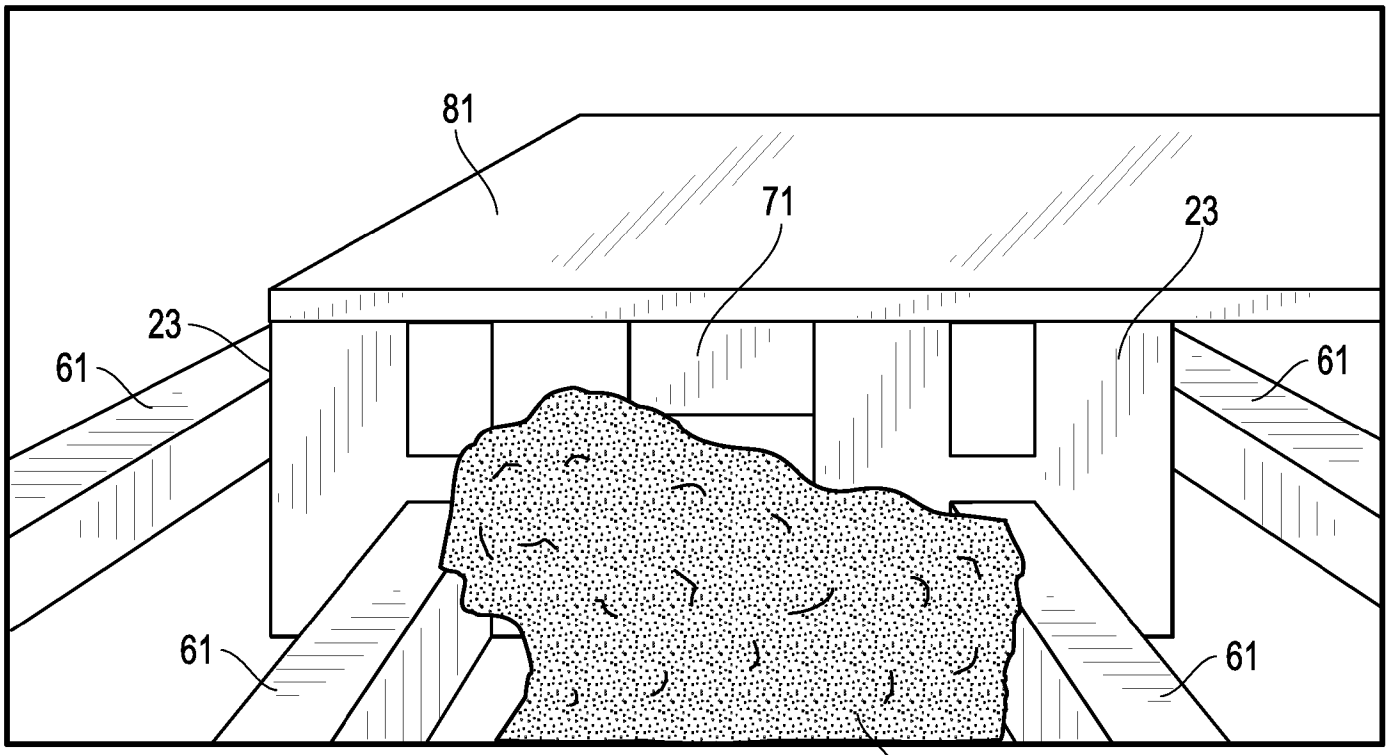
FIG. 9 is a side isometric view of an embodiment of an installed attic storage system.

The support structure 21 may further comprise a ruler 51 (FIGS. 2 and 9). The ruler 51 may be formed on or affixed to at least one surface (e.g., the front 29) of base 23.

Referring now to FIGS. 4-8, embodiments of a system and method of forming a support surface in an attic for attic storage are disclosed. The system may comprise an attic having attic joists 61 (FIG. 4), such as those shown extending upward from an attic floor. In conventional home construction, the attic joists 61 comprise continuous beams and have no slots. A plurality of support structures 21 or bases 23 may be mounted to the attic joists 61. Each base 23 may be configured in any of the embodiments described herein.

In one embodiment, the bottom slots 47 of the bases 23 receive the attic joists 61. In some versions, the bases 23 do not directly contact each other, and are spaced apart from other on the attic joists 61. The bases 23 may be positioned on the attic joists 61 and attached with or without fasteners, such as nails or screws. If fasteners are used, the bases 23 may be attached to the attic joists 61 in any suitable manner. For example, FIG. 1 depicts base 23 with pre-drilled holes or designated locations 37 for fastener attachments to attic joists 61. In addition, locations similar to locations 37 and/or fasteners could be used in conjunction with any or all of the slots 41, 43, 45, 47.

In some embodiments, the bases 23 make contact and rest only on the attic joists 61, such that the bases 23 do not make contact with the attic floor. Such versions may include a space or clearance directly beneath the bottoms 27 of the bases 23, and above the attic floor.

Figure 5:
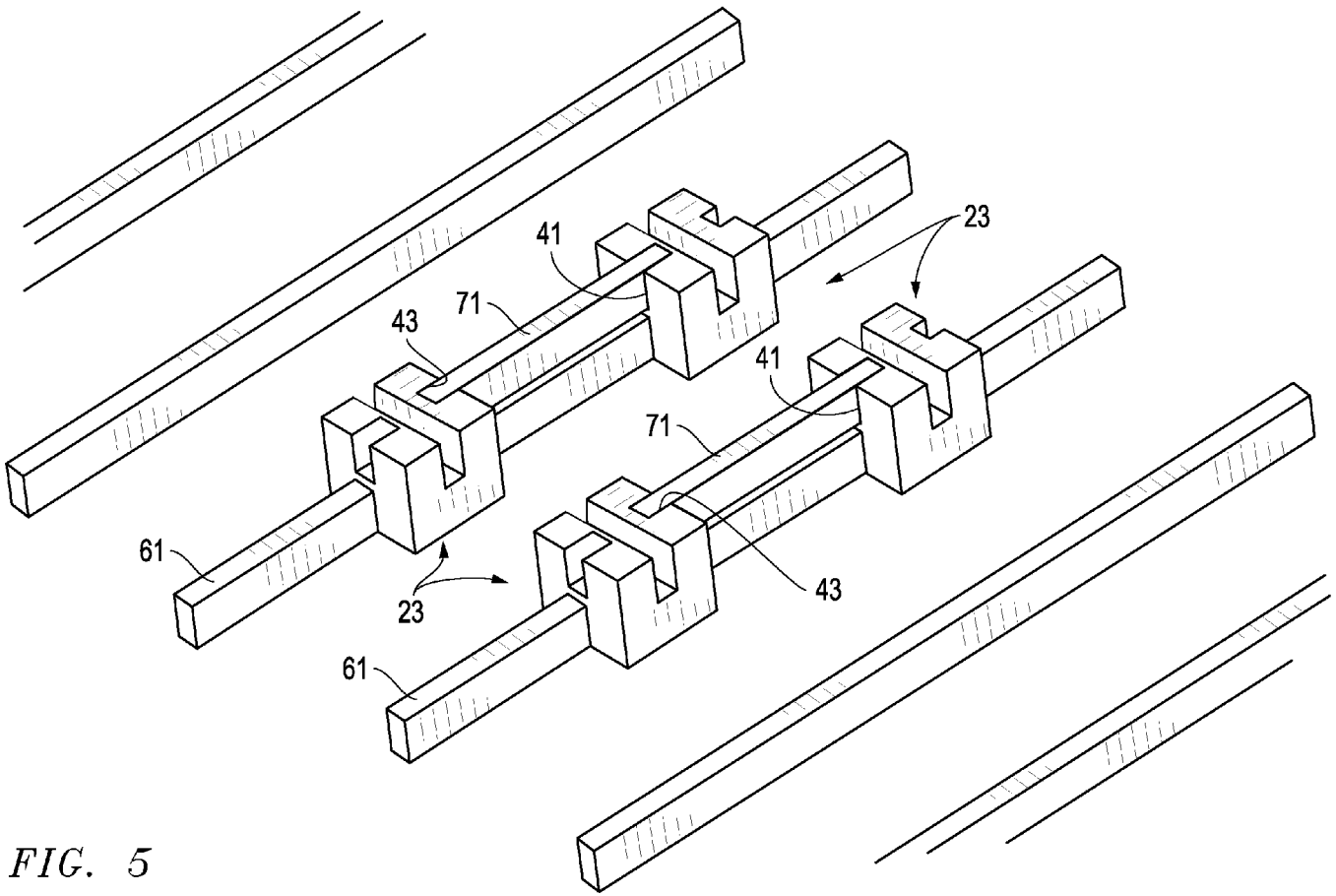
FIG. 5 is a front isometric view of an embodiment of an attic storage system at a stage of installation subsequent to FIG. 4.

As shown in FIG. 5, a plurality of conventional lumber studs 71 may be installed and extend between the bases 23. For example, at least some of the lumber studs 71 may comprise 2×4 inch studs. In one embodiment, a lumber stud 71 may extend from the top rear slot 43 of a first base 23 (e.g., the left-most bases 23 in FIG. 5), to the top front slot 41 of a second base 23 (e.g., the right-most bases 23 in FIG. 5). Such lumber studs 71 may be cut at a desired length, such as a desired spacing (e.g., four feet) between adjacent ones of the bases 23, such as those on the same attic joist 61.

In some versions, additional lumber studs 71 (FIG. 6) may be used between adjacent ones of the bases 23, such as those that are not on the same attic joist 61. For example, these additional lumber studs 71 may extend through the second top slots 45 of adjacent ones of the bases 23. Embodiments of the system and method may include the tops 25 of the bases being flush with the tops of the lumber studs 71, as shown. Thus, in some embodiments, the bases 23 are connected to two or more other bases 23 (e.g., two, three or four other bases 23; see FIG. 8B) by the lumber studs 71.

Figure 6:
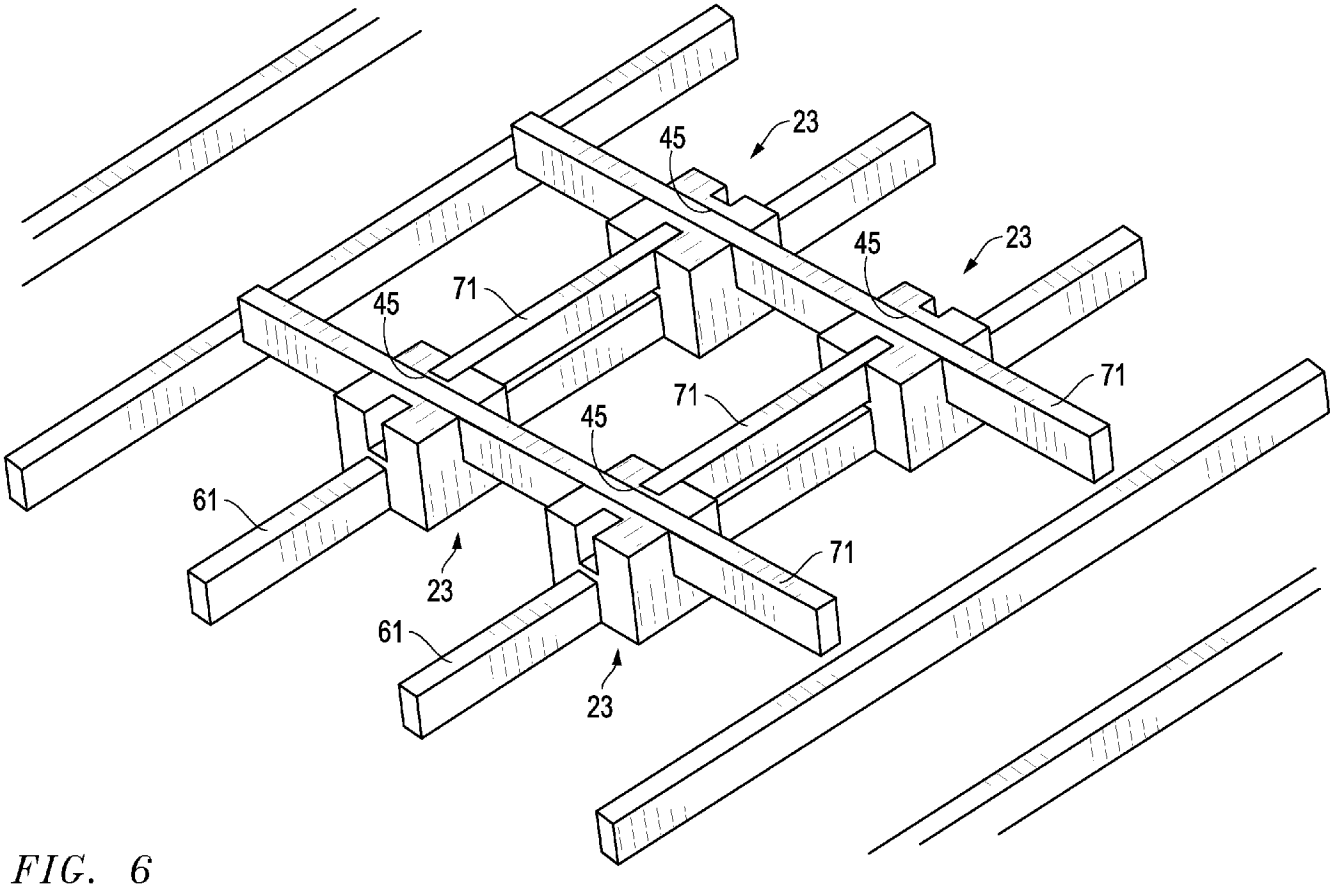
FIG. 6 is a front isometric view of an embodiment of an attic storage system at a stage of installation subsequent to FIG. 5.
Figure 7:
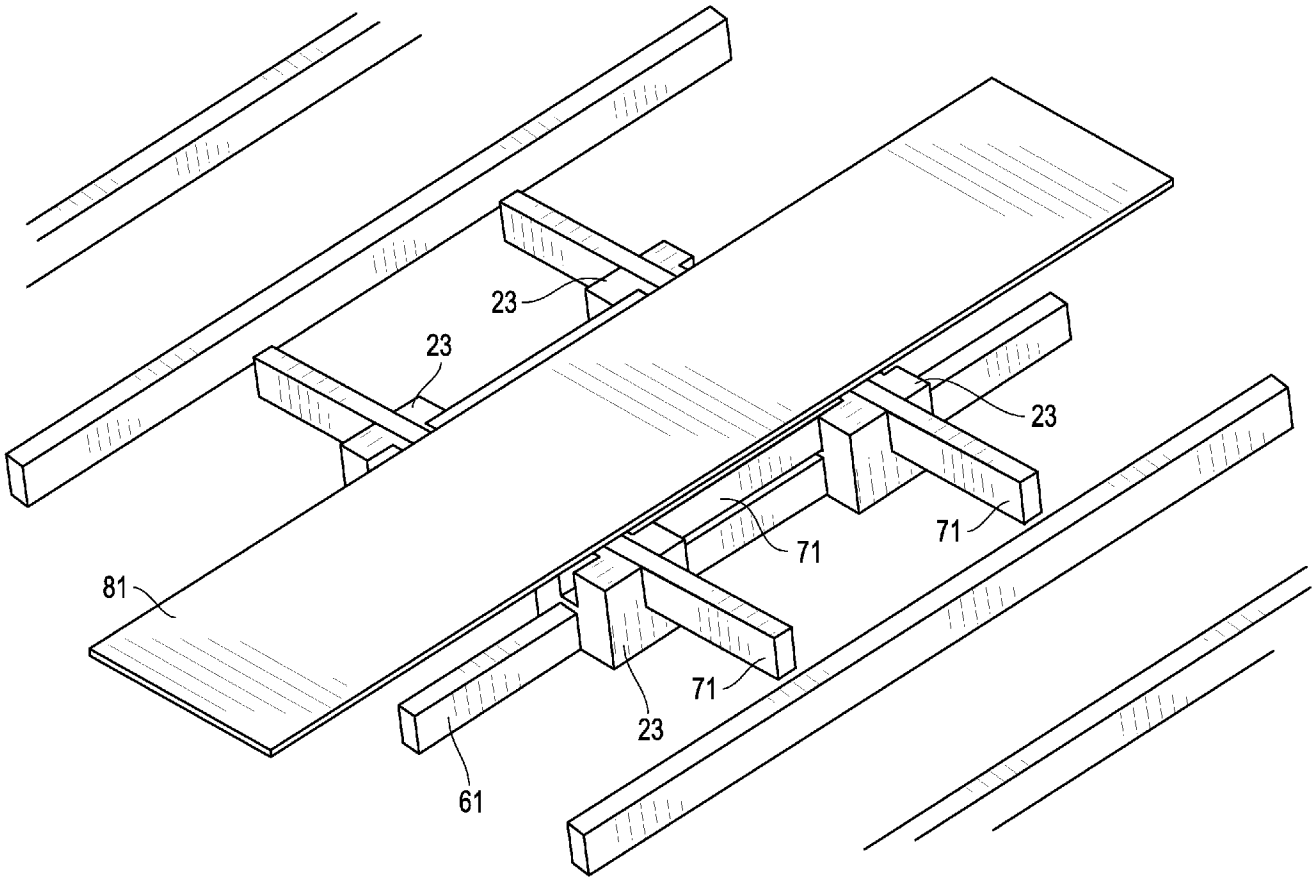
FIG. 7 is a front isometric view of an embodiment of an attic storage system at a stage of installation subsequent to FIG. 6.
Figure 8B:
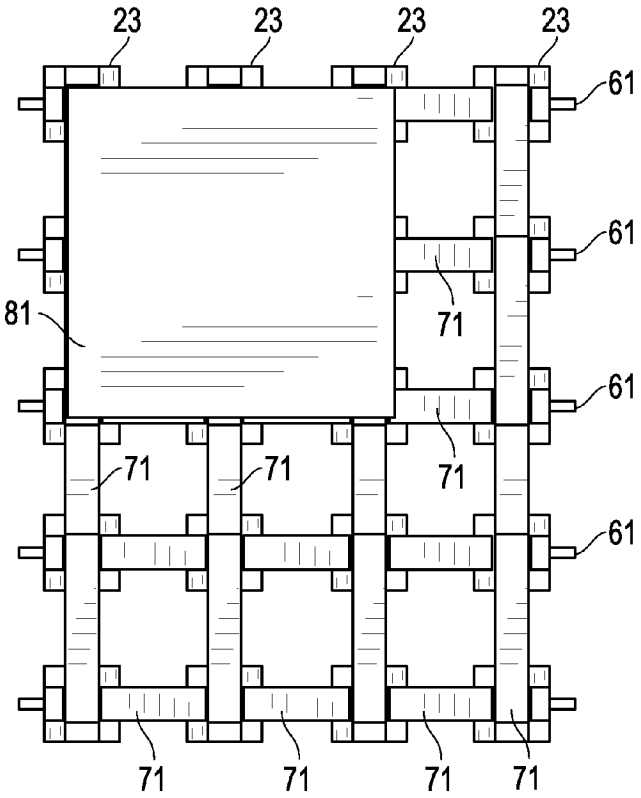
FIGS. 8A and 8B are top views of alternate embodiments of partially installed attic storage systems.
Figure 8A:
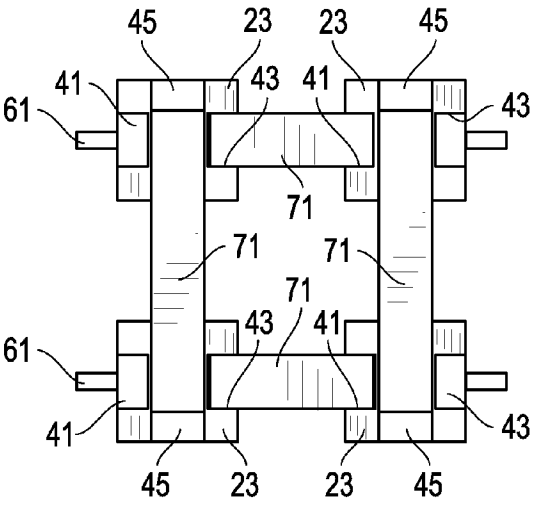

In the embodiments of FIGS. 5-7, the lumber studs 71 may be vertically oriented, whereas in the embodiments of FIGS. 8A and 8B the lumber studs 71 may be horizontally oriented. Such orientations affect the configuration and shape of the bases and their slots. The lumber studs 71 may be positioned on the bases 23 and attached with or without fasteners.

In addition, one or more conventional lumber panels 81 may be mounted to the lumber studs 71. In some examples, at least some of the lumber panels 81 may comprise at least one of a sheet of wood, particle board, plywood, oriented strand board (OSB). The lumber panels 81 may be configured with a width that exceeds a depth thereof. For example, typical lumber panels can be in a variety of width to thickness ratios, such as 8:1, 12:1, 16:1, 24:1, or even as high as 96:1. In some embodiments, the lumber panels are of sufficient length that they extend beyond at least two of the parallel lumber studs 71.

The lumber panels 81 may be positioned on the bases 23 and lumber studs 71, and attached with or without fasteners. If fasteners are used, the bases 23, lumber studs 71 and lumber panels 81 may be attached in any suitable manner. The lumber panels 81 form the top platform for the attic storage support surface.

In some embodiments, at least some of the bases 23 are not mounted to adjacent ones of the attic joists 61, such that at least some of the attic joists 61 beneath the lumber panels 81 do not have bases 23 mounted to them.

The system and method may include embodiments wherein no insulation is located on the floor of the attic, at least between the joists 61 prior to mounting the bases 23 to the joists 61. Embodiments may further comprise adding insulation after the bases 23 are installed (for example, after lumber studs 71 are installed, but before lumber panels 81 are installed and completion of the entire support surface), such that at least some of the insulation is added between the attic floor and the bottoms 27 of the bases 23. In some versions (FIG. 9), at least some of the insulation 91 extends to an elevation above the bottoms 27 of the bases 23 and below a lower surface of the support surface formed by the lumber panels 81.

In other embodiments, insulation is located on the attic floor, at least between the attic joists 61, prior to mounting the bases 23 to the joists 61. In some versions, at least some of the insulation is compressed by the bases 23 when the bases 23 are mounted to the attic joists 61. In other versions, the insulation can be temporarily cleared away from the locations of the bases 23 prior to their installation on attic joints 61. The cleared insulation can be returned to positions on the attic floor (FIG. 9) adjacent to and in contact with the bases 23 after the bases 23 are installed on attic joists 61.

In still other embodiments, a kit, such as an attic storage kit, may comprise a plurality of the bases 23 in a container (e.g., a bag or box). The kit may include one or more of the following items including, for example, fasteners, lumber, additional hardware, installation tools, and templates for installation.

Embodiments also may comprise one or more of the following items.

Item 1. A support structure, comprising:

- a base having surfaces including a top, a bottom, a front, a rear and sides;
- a first top slot formed in the top and extending at least partially between the front and the rear;
- a second top slot formed in the top and extending at least partially between the sides; and
- a bottom slot formed in the bottom.

Item 2. The support structure of item 1, wherein the first top slot comprises a top front slot that extends from the front to adjacent a center of the top, and a top rear slot that extends from the rear to adjacent the center of the top.

Item 3. The support structure of item 2, wherein the top front slot is separated from the top rear slot by the second top slot.

Item 4. The support structure of item 2, wherein the top front slot extends along the front from the top to adjacent a center of the front.

Item 5. The support structure of item 2, wherein the top rear slot extends along the rear from the top to adjacent a center of the rear.

Item 6. The support structure of item 1, wherein the first and second top slots intersect and extend completely across the top.

Item 7. The support structure of item 1, wherein the top comprises a third top slot for a total of only three slots in the top.

Item 8. The support structure of item 1, wherein the top comprises a third top slot and a fourth top slot, and none of the top slots intersect each other.

Item 9. The support structure of item 1, wherein all of the slots are orthogonal to each other.

Item 10. The support structure of item 1, wherein at least two of the slots intersect each other at an angle that is not orthogonal.

Item 11. The support structure of item 1, wherein the slots are orthogonal to each other, but not orthogonal to the surfaces of the base.

Item 12. The support structure of item 1, wherein the slots are not orthogonal to each other, and not orthogonal to the surfaces of the base.

Item 13. The support structure of item 1, wherein none of the slots intersect each other.

Item 14. The support structure of item 1, wherein the second top slot extends completely across the top from side to side.

Item 15. The support structure of item 1, wherein the bottom slot is the only slot in the bottom, and the bottom slot extends completely across the bottom from front to back, or from side to side.

Item 16. The support structure of item 1, wherein each slot is configured to receive conventional lumber studs.

Item 17. The support structure of item 1, wherein the base is solid or hollow.

Item 18. The support structure of item 1, wherein the base is a block that is substantially rectangular in shape, substantially cubic in shape, substantially curvilinear in shape, or substantially spherical in shape.

Item 19. The support structure of item 1, wherein an entirety of the base is formed from a single material or from a composite of materials.

Item 20. The support structure of item 1, wherein the base comprises at least one of an inorganic material, an organic material, an organic material other than wood, fungal material, mycelium foam, an open cell structure, a closed cell structure, a polymeric foam, a rigid polyurethane, polystyrene, polypropylene, a cellular plastic and a rigid plastic.

Item 21. The support structure of item 1, wherein the base comprises a density of at least about 0.5 lb/ft3, at least about 1 lb/ft3, at least about 2 lb/ft3, at least about 5 lb/ft3, at least about 10 lb/ft3, not greater than about 25 lb/ft3, not greater than about 20 lb/ft3, not greater than about 15 lb/ft3, not greater than about 12 lb/ft3, not greater than about 10 lb/ft3.

Item 22. The support structure of item 1, wherein the base has an insulation rating of at least about R0.5/inch, at least about R1/inch, at least about R2/inch, at least about R3/inch, at least about R4/inch, at least about R5/inch, not greater than about R9/inch, not greater than about R8/inch, not greater than about R7/inch, not greater than about R6/inch, not greater than about R5/inch, not greater than about R4/inch.

Item 23. The support structure of item 1, wherein the base has a nail pull strength of at least about 10 lbs, at least about 25 lbs, at least about 50 lbs, at least about 100 lbs, at least about 150 lbs, not greater than about 350 lbs, not greater than about 300 lbs, not greater than about 250 lbs, not greater than about 200 lbs, not greater than about 150 lbs, not greater than about 100 lbs.

Item 24. The support structure of item 1, wherein the base has a screw hold strength of at least about 25 lbs, at least about 50 lbs, at least about 100 lbs, at least about 200 lbs, at least about 300 lbs, at least about 400 lbs, not greater than about 1000 lbs, not greater than about 900 lbs, not greater than about 800 lbs, not greater than about 700 lbs, not greater than about 600 lbs, not greater than about 500 lbs.

Item 25. The support structure of item 1, wherein the base has a compressive strength of at least about 15 lbs/ft2, at least about 25 lbs/ft2, at least about 40 lbs/ft2, at least about 50 lbs/ft2, at least about 60 lbs/ft2, at least about 70 lbs/ft2, not greater than about 600 lbs/ft2, not greater than about 500 lbs/ft2, not greater than about 400 lbs/ft2, not greater than about 300 lbs/ft2, not greater than about 200 lbs/ft2, not greater than about 175 lbs/ft2, not greater than about 150 lbs/ft2, not greater than about 125 lbs/ft2, not greater than about 100 lbs/ft2.

Item 26. The support structure of item 1, further comprising a ruler on at least one of surfaces.

Item 27. A system for attic storage, comprising:

an attic having attic joists;

a plurality of support structures, each comprising a base, mounted to the attic joists;

at least two conventional lumber studs extending between adjacent ones of the bases; and a plurality of lumber panels mounted to at least one of the bases and the lumber studs.

Item 28. The system of item 27, wherein at least some of the bases have three or four lumber studs mounted thereto and extending to other bases.

Item 29. The system of item 27, wherein tops of the bases and tops of the lumber studs are substantially flush with each other.

Item 30. The system of item 27, wherein at least some of the bases are not mounted to adjacent ones of the joists, such that at least some of the joists beneath the plurality of lumber panels do not have bases mounted to them.

Item 31. The system of item 27, wherein at least some of the lumber studs comprise 2×4 inch studs, and the lumber panels comprise at least one of a sheet of wood, particle board, plywood, oriented strand board (OSB).

Item 32. The system of item 27, wherein at least some of the support structures are configured according to one or more of items 1-26.

Item 33. A method of forming a support surface in an attic, the attic having a floor, and attic joists extending upward from the floor, the method comprising:

mounting a plurality of support structures, each comprising a base, to the attic joists;

mounting two or more studs to at least some of the bases; and mounting at least one panel to at least one of the bases and the studs to form a support structure.

Item 34. The method of item 33, wherein insulation is located on the floor of the attic at least between the joists prior to mounting the bases to the joists, such that at least some of the insulation is compressed by the bases when the bases are mounted to the joists.

Item 35. The method of item 33, wherein no insulation is located on the floor of the attic at least between the joists prior to mounting the bases to the joists, and further comprising adding insulation after completion of the support surface, such that at least some of the insulation is added between the floor of the attic and the bottoms of the bases, and at least some of the insulation extends to an elevation above the bottoms of the bases and below a lower surface of the support surface.

Item 36. The method of item 33, wherein at least some of the support structures are configured according to one or more of items 1-26.

Item 37. A kit, comprising:

at least four support structures, each comprising a base, and each of the bases comprises:

surfaces including a top, a bottom, a front, a rear and sides;

a first top slot formed in the top and extending at least partially between the front and the rear;

a second top slot formed in the top and extending at least partially between the sides; and a bottom slot formed in the bottom; and the kit further comprises:

a container for containing the at least four support structures.

Item 38. The kit of item 37, wherein the kit comprises an attic storage kit, and the container comprises a bag or a box.

Item 39. The kit of item 37, further comprising at least one of fasteners, lumber, hardware, an installation tool and a template for installation.

Item 40. The kit of item 37, wherein at least some of the support structures are configured according to one or more of items 1-26.

Item 41. A system for attic storage according to any one of the preceding items, the system comprising:

an attic having attic joists;

a plurality the support structures, each mounted to the attic joists;

at least two lumber studs extending between adjacent ones of the support structures; and a plurality of lumber panels mounted to at least one of the support structures and the lumber studs.

Item 42. An attic storage kit according to any one of the preceding items, the attic storage kit comprising:

at least four of the support structures; and a container for containing the at least four support structures.

The embodiments disclosed herein can increase storage space in attics, where studs and rafters may be covered by loose fill insulation. In some versions, pre-molded attic rafter extensions allow a platform to be installed at a higher height than the top of the attic rafters, such as about 8 inches to about 12 inches. The rafter extensions can provide a storage space and allow access over insulation up to about R-60. This design enables a user to access attic storage without stepping in or crushing installed loose fill insulation. The rafter extensions may be installed, and then additional common lumber can be placed on top of the extensions to make the platform area. In some embodiments such as residential home attics, the embodiments may be utilized either during the initial installation of insulation, or as a part of a retrofit after installation has been installed. The extensions may be formed from a material that is structurally strong enough to support loads, but still offer insulating value itself, while not forming a thermal bridge through the loose fill insulation.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A support structure, comprising:

a base mounted to an attic joist, the base having surfaces including a top, a bottom, a front, a rear and sides;

a first top slot formed in the top and extending at least partially between the front and the rear;

a second top slot formed in the top and extending at least partially between the sides; and a bottom slot formed in the bottom.

2. The support structure of claim 1, wherein the first and second top slots intersect and extend completely across the top, and the top comprises a third top slot for a total of only three slots in the top.

3. The support structure of claim 1, wherein the top comprises a third top slot and a fourth top slot, and none of the top slots intersect each other.

4. The support structure of claim 1, wherein the slots are orthogonal to each other.

5. The support structure of claim 1, wherein the second top slot extends completely across the top from side to side, and the bottom slot is the only slot in the bottom, and the bottom slot extends completely across the bottom from front to back, or from side to side.

6. The support structure of claim 1, wherein the base comprises a density of between about 0.5 $lb/ft^3$ and about 25 $lb/ft^3$.

7. The support structure of claim 1, wherein the base has an insulation rating of between about R0.5/inch and about R9/inch.

8. The support structure of claim 1, wherein the base comprises:

a nail pull strength of between about 10 lbs and about 350 lbs; and a screw hold strength of between about 25 lbs and about 1000 lbs.

9. The support structure of claim 1, wherein the base has a compressive strength of between about 15 lbs/ft$^2$ and about 600 lbs/ft$^2$.

10. The support structure of claim 1, wherein the base comprises at least one of an inorganic material, an organic material, an organic material other than wood, fungal material, mycelium foam, an open cell structure, a closed cell structure, a polymeric foam, a rigid polyurethane, polystyrene, polypropylene, a cellular plastic and a rigid plastic.

11. The support structure of claim 1, wherein the first top slot comprises a top front slot that extends from the front to adjacent a center of the top, and a top rear slot that extends from the rear to adjacent the center of the top.

12. The support structure of claim 11, wherein the top front slot is separated from the top rear slot by the second top slot.

13. The support structure of claim 11, wherein the top front slot extends along the front from the top to adjacent a center of the front, and the top rear slot extends along the rear from the top to adjacent a center of the rear.

14. An attic storage kit, comprising:

at least four support structures, each comprising a base configured to be mounted to a respective attic joist, and each of the bases comprises:

surfaces including a top, a bottom, a front, a rear and sides;

a first top slot formed in the top and extending at least partially between the front and the rear;

a second top slot formed in the top and extending at least partially between the sides; and a bottom slot formed in the bottom; and the attic storage kit further comprises:

a container comprising a bag or a box for containing the at least four support structures; and at least one of fasteners, lumber, hardware, an installation tool or a template for installation.

* * * * *